United States Patent [19]

Brown

[11] 4,357,740

[45] Nov. 9, 1982

[54] BAG CLOSURE DEVICE

[76] Inventor: Theodore G. Brown, 5735 Falconer Way, Sacramento, Calif. 95824

[21] Appl. No.: 264,359

[22] Filed: May 18, 1981

[51] Int. Cl.[3] ..... B65D 77/10

[52] U.S. Cl. ..... 24/30.5 S; 24/255 BS; 229/62; 150/3

[58] Field of Search ..... 24/30.5 S, 30.5 L, 30.5 T, 24/30.5 P, 30.5 R, 255 BS, 143 B, DIG. 28; 229/62; 150/3

[56] References Cited

U.S. PATENT DOCUMENTS 3,357,070 12/1967 Sloan ..... 24/255 BS
3,775,810 12/1973 Smith, Jr. et al. ..... 24/30.5 S

FOREIGN PATENT DOCUMENTS 684419 4/1964 Canada ..... 24/30.5 S
459872 9/1968 Switzerland ..... 24/30.5 S

*Primary Examiner*—Mickey Yu
*Attorney, Agent, or Firm*—Norman B. Rainer

[57] ABSTRACT

A device of integral construction having resilient prongs in a symmetrically concave shell is capable of gripping thin film material of which plastic bags are fabricated. The device can thereby effect closure of such bags. The gripping characteristics of the device can be transiently modified to cause release of a gripped film, thereby permitting re-opening of such bags. The transient modification of the gripping characteristics is achieved by manually applying compressional force to levers associated with the prongs adjacent the base of the shell.

2 Claims, 4 Drawing Figures

BAG CLOSURE DEVICE

BACKGROUND OF THE INVENTION

This invention relates to closure devices for plastic bags, and more particularly to closure devices having resilient prongs capable of gripping a plastic bag.

Devices have been disclosed in U.S. Pat. No. 4,189,808 for closing the open mouth of a bag fabricated of thin plastic film. Said devices are comprised of a single integral conically shaped plastic structure having slots which define interactive resilient prongs. When a plastic bag is drawn from the base of the cone and thence between the prongs, the bag is gripped and cannot be withdrawn.

It has been found however that there would be considerable advantage in providing a bag closure device of the general nature of the aforesaid patent whose closure action would be reversible, namely a device which could be removed from a bag, thereby permitting reopening of a previously closed bag. Any such device, to be of commercial value, would have to be of economical design and capable of single hand operation.

It is accordingly an object of the present invention to provide a device having resilient prongs capable of gripping thin plastic film drawn between said prongs and further capable of releasing the gripped film.

It is another object of this invention to provide a device of the aforesaid nature of economical construction and capable of releasing a gripped film by single hand manipulation.

These objects and other objects and advantages of the invention will be apparent from the following description.

SUMMARY OF THE INVENTION

The above and other beneficial objects and advantages are accomplished in accordance with the present invention by an improved closure device which comprises a structure fabricated of resilient material, said structure comprising a concavely shaped shell having a plurality of elongated slots therein oriented between the apex of said shell and the base thereof, said slots intersecting to define closely spaced prongs of substantially triangular configuration, and levers extending from said base in a direction opposite to said apex, said levers being positioned adjacent the midpoints of the bases of said prongs. Said levers, when grasped by hand and squeezed inwardly toward the interior of the base, cause said prongs to move apart to release anything gripped thereby. The shell is preferably contoured as a surface of revolution such as a cone, parabola or hemisphere having an axis of symmetry and a circular base.

In a preferred embodiment, the closure device is an integral monolithic structure molded from thermoplastic polymer material.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
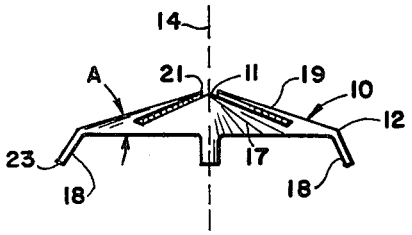
FIG. 1 is a side elevational view of an embodiment of the closure device of the present invention.
Figure 2:
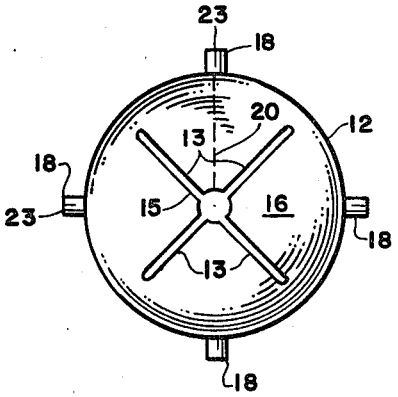
FIG. 2 is a top view of the embodiment of FIG. 1.
Figure 3:
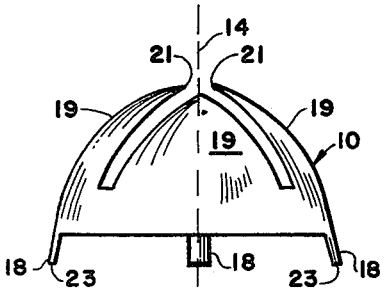
FIG. 3 is a side elevational view of another embodiment of the closure device of the present invention.

Referring more specifically to the drawing, the closure device is a button-like structure formed of resilient material, preferably plastic having a uniform thickness in the range of one to three sixteenths of an inch. The structure of FIG. 1 is comprised of a concially shaped shell 10 of substantially uniform thickness having an apex 11, circular base 12, outer surface 16, and inner surface 17. The angle of the cone, namely angle A of FIG. 1, may range from about 5° to 30°. The shell may be slightly truncated, said truncation being no more than about 15% of the height the cone would have if provided with a truly pointed apex. The diameter of base 12 may range between about 20 and 60 millimeters, and the height of said shell from base to apex may range between about 3 and 5 millimeters.

Elongated slots 13 in shell 10 are oriented substantially in planes containing the center axis of symmetry 14 of said shell and equiangularly spaced about said axis. The slots are defined essentially by paired opposed edge surfaces 15 extending perpendicularly between inner and outer surfaces and spaced between about 0.5 and 2.0 millimeters apart in substantially parallel disposition. Although the illustrated embodiment shows four slots, their number may range from three to six. Auxiliary slots may in some embodiments be provided in planes parallel to said base to secure modified properties and appearance. The slots define triangular prongs 19 having extremities 21 capable of resilient motion in directions toward and away from said center axis. Said triangular prongs have essentially the configuration of isosceles triangles.

Figure 4:
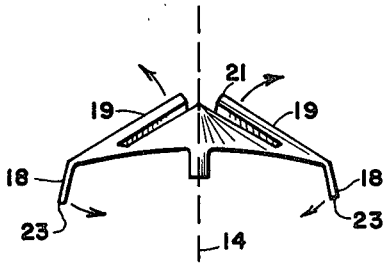
FIG. 4 is a side view of the embodiment of FIG. 1 shown during transient inward displacement of the levers.

Levers 18 appendaged to base 12 as continuous integral extensions thereof, are directed away from said apex and terminate in distal ends 23. Each lever is centered substantially at the perpendicular bisector 20 of each of said triangular prongs. The length of each lever may range from about 2 to 5 millimeters. When the levers are grasped and squeezed so as to displace distal ends 23 toward one another to a substantially circular locus of smaller diameter, the extremities 21 of associated prongs 19 are caused to move away from said axis, as shown by the arrows of FIG. 4.

In some embodiments, the closure device may have adjacent base 12 a circumferential lip extending outwardly from the conical shell and upturned in the direction of the apex.

The closure device of this invention may be fabricated by injection molding or stamping from sheet stock material.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A closure device of integral construction fabricated of resilient material comprising a concave shell symmetrically shaped about a center line axis and having a circular base, a plurality of elongated slots in said shell equiangularly spaced about said axis and oriented within planes containing said axis, said slots cooperatively defining closely spaced prongs of substantially triangular configuration capable of gripping a plastic film positioned therebetween, and levers emanating outwardly from said base, said levers being positioned adjacent the perpendicular bisectors of said triangular prongs, whereby when said levers are grasped by hand and squeezed inwardly toward the interior of said circular base, said prongs are caused to move apart and thereby release a gripped plastic film.

2. The device of claim 1 wherein said concave shell has the configuration of a surface of revolution about a straight line axis and includes a cone shape, parabolical shape and hemispherical shape.

* * * * *